United States Patent [19]

Mori

[11] Patent Number: 4,560,847

[45] Date of Patent: Dec. 24, 1985

[54] POWER SWITCH

[75] Inventor: Teijiro Mori, Hyogo, Japan

[73] Assignee: Mitsubishi Denki Kabushiki Kaisha, Tokyo, Japan

[21] Appl. No.: 623,749

[22] Filed: Jun. 22, 1984

[51] Int. Cl.[4] ..... H01H 33/08; H01H 33/10

[52] U.S. Cl. ..... 200/144 R; 200/147 R

[58] Field of Search ..... 200/144 R, 147 R, 146 R

[56] References Cited

U.S. PATENT DOCUMENTS

| | | | |
|---|---|---|---|
| 4,080,520 | 3/1978 | Muller | 200/144 R |
| 4,229,630 | 10/1980 | Wafer et al. | 200/147 R |
| 4,237,355 | 12/1980 | Fechant et al. | 200/147 R |
| 4,295,022 | 10/1981 | Robins | 200/144 R |
| 4,387,281 | 6/1983 | Haury et al. | 200/147 R |
| 4,477,704 | 10/1984 | Mori et al. | 200/147 R |

*Primary Examiner*—Robert S. Macon

*Attorney, Agent, or Firm*—Sughrue, Mion, Zinn, Macpeak & Seas

[57] ABSTRACT

An electric power switch including a stationary contact piece, a movable contact piece which is moved into and out of engagement with the stationary contact piece, and a commutation electrode arranged near the stationary contact piece and the movable contact piece to receive an arc which is formed when the movable contact piece is disengaged from the stationary contact piece. Current control is performed by moving the movable contact piece into and out of engagement with the stationary contact piece. A plurality of metal arc-extinguishing plates are arranged parallel to the surface of the stationary contact piece and at a predetermined distance from the commutation electrode, extending in the direction in which the movable contact piece is moved with respect to the stationary contact piece. A predetermined distance is maintained between the commutation electrode and the metal arc-extinguishing plates.

11 Claims, 13 Drawing Figures

POWER SWITCH

BACKGROUND OF THE INVENTION

The present invention relates to electric power switches, and more particularly to an electric power switch, such as an electromagnetic contactor or circuit breaker, having an improved performance.

A conventional electric power switch such as an electromagnetic contactor is designed as shown in FIG. 1. In FIG. 1, reference numeral 1 designates a plastic mounting base; 2, a stationary iron core formed by stacking silicon steel plates; 3, a movable iron core which is a laminate of silicon steel plates; 4, an operating coil for providing a drive force which causes the stationary iron core 2 to attract the movable iron core 3 against the elastic force of a tripping spring (not shown); and 5, a cross bar made of plastic, the cross bar 5 having a rectangular window 5A and holding the movable iron core 3 at the lower end. Further in FIG. 1, reference numeral 6 designates a movable contact piece inserted into the rectangular window 5A of the cross bar 5; 6A, a movable contact on one end of the movable contact piece 6; 7, a spring adapted to depress the movable contact piece 6; and 8, a stationary contact piece having a stationary contact 8A on one end and a terminal 8B at the other end and arranged in such a manner that it is engageable with the movable contact 6A. When the contacts 6A and 8A are in contact with each other, current flows from the stationary contact piece 8 to the movable contact 6. Further in FIG. 1, reference numeral 9 designates a terminal screw for connecting the electromagnetic contactor body to an external circuit; 10, a base on which the stationary contact piece 8 is mounted; 11, an arc cover which covers the electromagnetic contact; 12, an arc formed between the stationary contact 8A and the movable contact 6A; and 13, metal arc-extinguishing plates made of a magnetic material and used for extinguishing the arc 12, the plates 13 being arranged parallel to the joint surface of the stationary contact piece 8 and the stationary contact 8A. The abovedescribed components are arranged symmetrically with respect to the central axis of the electromagnetic contactor. FIG. 1 shows a sectional view of the right-handed half of the contactor.

When the operating coil 4 is deenergized, as shown in FIG. 1, the movable iron core 3 is disengaged from the stationary iron core 2 by the tripping spring (not shown). Accordingly, the movable contact 6A and the stationary contact 8A are moved apart from one another, as a result of which an arc 12 is created between the contacts 6A and 8A. The arc 12 thus created, being attracted by the magnetic metal arc-extinguishing plates 13, moves from the state designated by 12B to that designated 12A. Finally, the arc is extinguished between the metal arc-extinguishing plates 13, and thus the current is interrupted.

In the conventional power switch constituted as described above, of the plurality of metal arc-extinguishing plates, only those which are located between the movable contact piece 6 and the stationary contact piece 8 contribute to arc extinction. Accordingly, the conventional power switch suffers from drawbacks that its interrupting performance is low and its contacts are rapidly consumed.

An electric power switch as disclosed by U.S. Pat. No. 4,429,198 has recently been proposed to overcome these difficulties. That electric power switch, as shown in FIG. 3, includes a plurality of metal arc-extinguishing plates 13 arranged perpendicular to the joint surface of the stationary contact piece 8 and the stationary contact 8A, and a commutation electrode 15 located between the movable contact piece 6 and the stationary contact piece 8 when the latter are disconnected from each other. However, that electric power switch is disadvantageous in that, since the metal arc-extinguishing plates 13 are remote from the arc 12, it cannot sufficiently drive the arc, and accordingly the arcing period is relatively long. Accordingly, especially in the case where it is required to interrupt a small current, because of the insufficient arc driving capacity described above, the arcing period becomes long when the voltage is high. Thus, the current interrupting performance is still unsatisfactory.

SUMMARY OF THE INVENTION

An object of the present invention is to provide an electric power switch in which the above-described difficulties accompanying a conventional electric power switch have been eliminated.

The foregoing object and other objects of the invention have been achieved by the provision of an electric power switch comprising a stationary contact piece with a movable contact which is moved into and out of engagement with the stationary contact; a commutation electrode arranged near the stationary and movable contacts in such a manner that, when the movable contact is disengaged from the stationary contact, the commutation electrode is at predetermined distances from the stationary contact and movable contact and receives an arc which is formed between the stationary contact and the movable contact; and a plurality of metal arc-extinguishing plates arranged parallel to the surface of the stationary contact piece and at a predetermined distance from the commutation electrode and extending in a direction in which the movable contact piece is moved with respect to the stationary contact piece.

The nature, principle and utility of the invention will become more apparent from the following detailed description and the appended claims when read in conjunction with the accompanying drawings.

DESCRIPTION OF THE PREFERRED EMBODIMENTS

Figure 1:
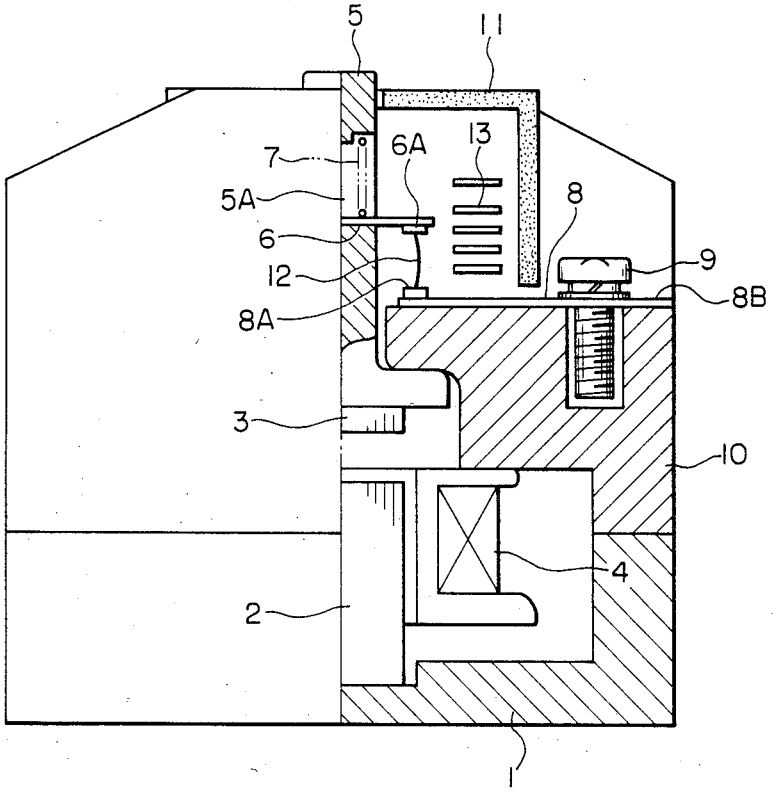
FIG. 1 PRIOR ART
FIG. 1 is an elevation, with its right half in vertical section, of a conventional electric power switch.
Figure 2:
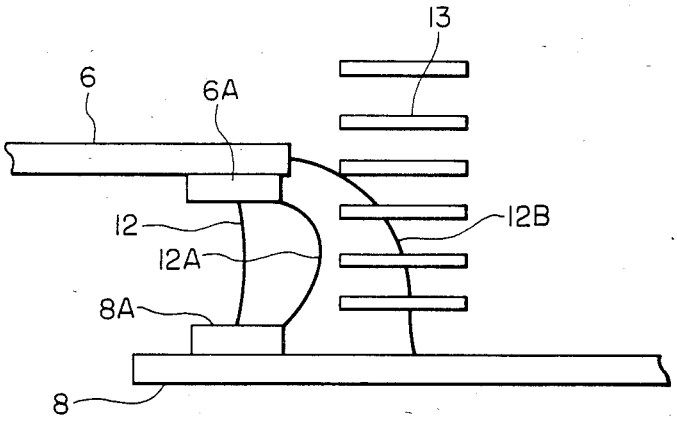
FIG. 2 PRIOR ART
FIG. 2 is an enlarged side view showing the essential components of the electric power switch in FIG. 1.
Figure 3:
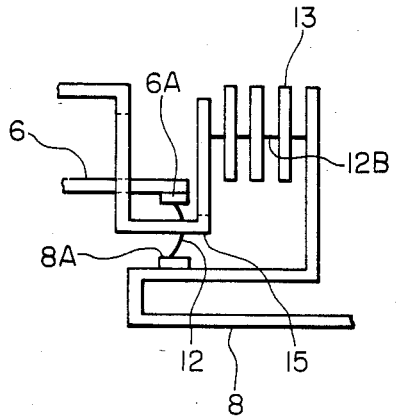
FIG. 3 PRIOR ART
FIG. 3 is also an enlarged side view showing the essential components of another conventional electric power switch.

A first preferred embodiment of a power switch of the invention, namely, an electromagnetic contactor with an arc runner, will be described with reference to FIGS. 4, 5 and 6.

In these figures, reference numeral 14 designates the aforementioned arc runner. The arc runner is electrically connected to the end 8C of the stationary contact piece 8 which is closer to the stationary contact 8A. The arc runner 14 has a slot 14A which is located immediately above the stationary contact 8A through which the movable contact piece **6*a* can be moved to the stationary contact 8A. Further, 15A, 15B, 15C and 15D designate respective first, second, third and fourth flat plates, and 15E, a slot through which the movable contact 6*a*** is moved up and down.

Figure 6:
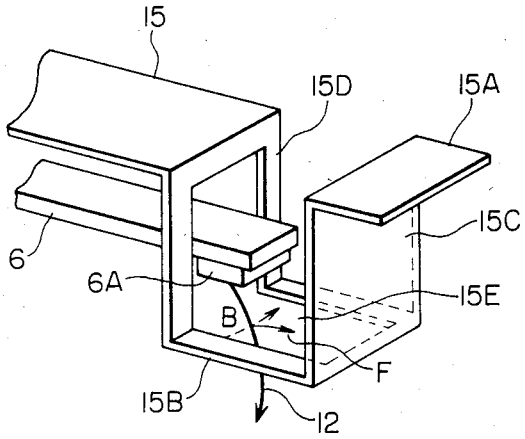
FIG. 6 is a perspective view showing a commutation electrode and a movable contact piece in the first embodiment of FIG. 4.
Figure 7:
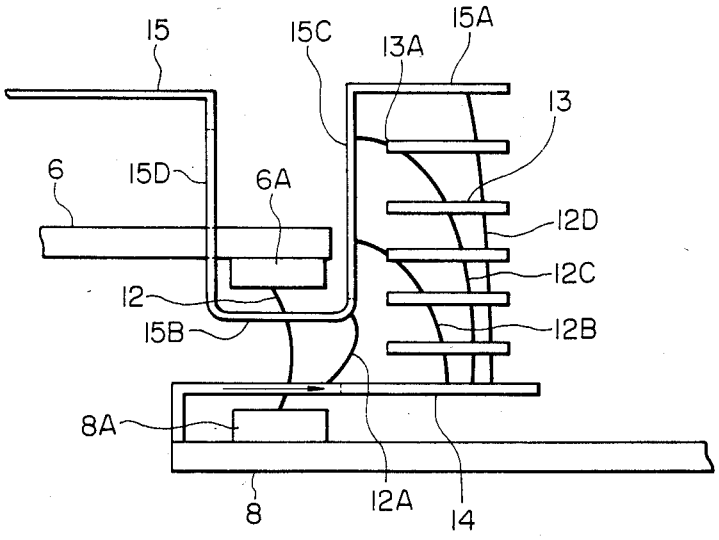
FIGS. 7 through 10 are enlarged side views showing modifications of the commutation electrode in the first embodiment of the invention.
Figure 8:
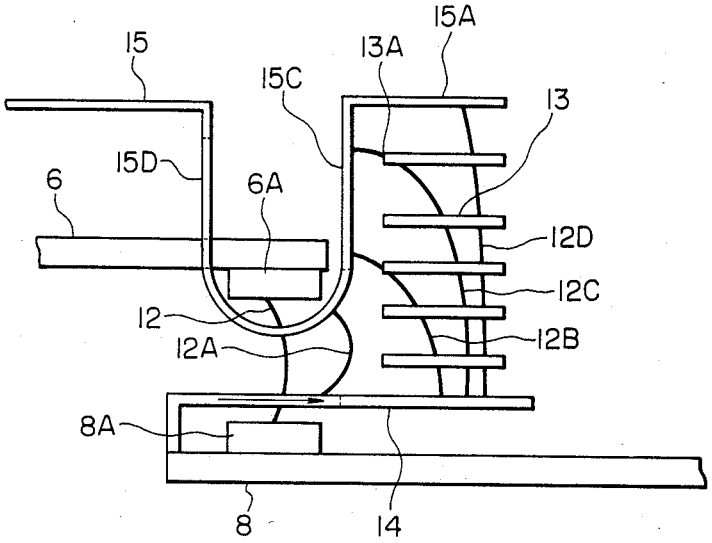
Figure 9:
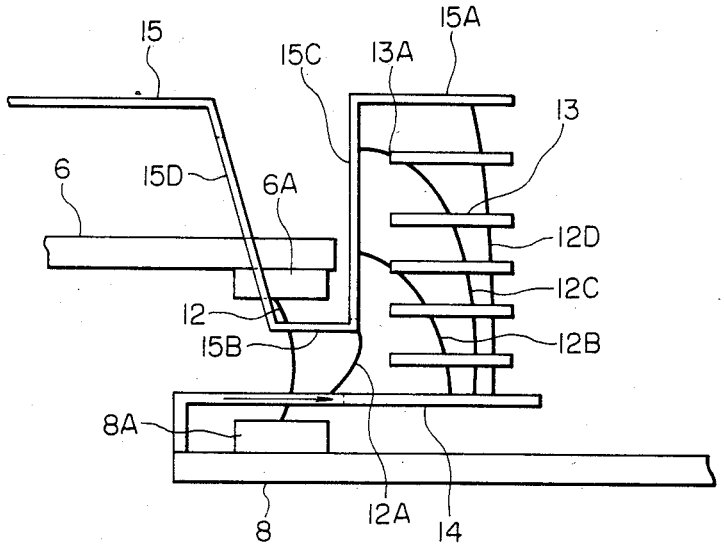
Figure 10:
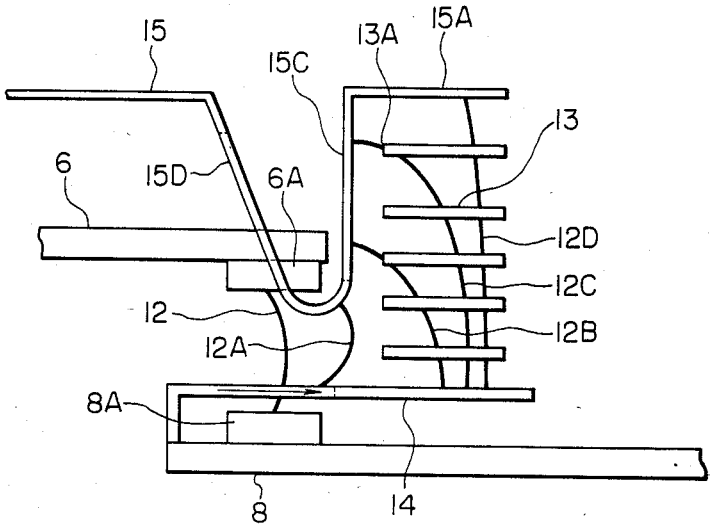

FIG. 6 shows the right half of the commutation electrode 15; the left half is similar.

Figure 4:
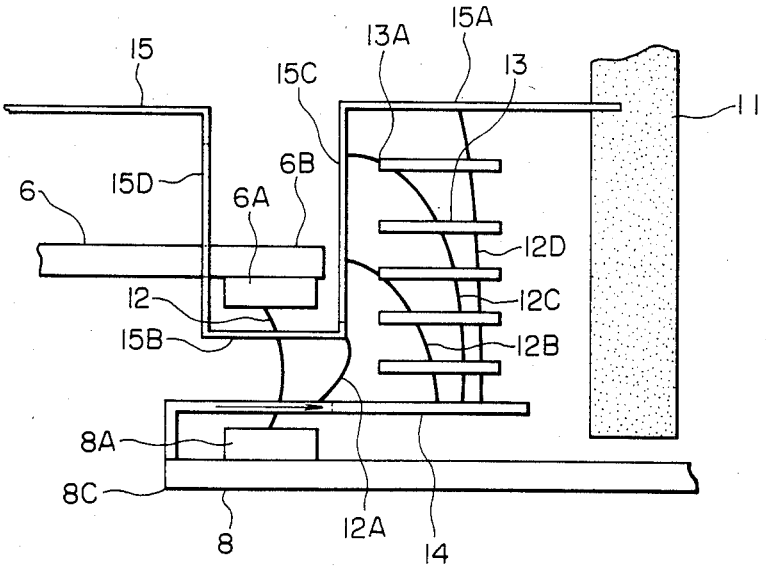
FIG. 4 is an enlarged side view showing the essential components of an electromagnetic contactor of a first embodiment of this invention.
Figure 5:
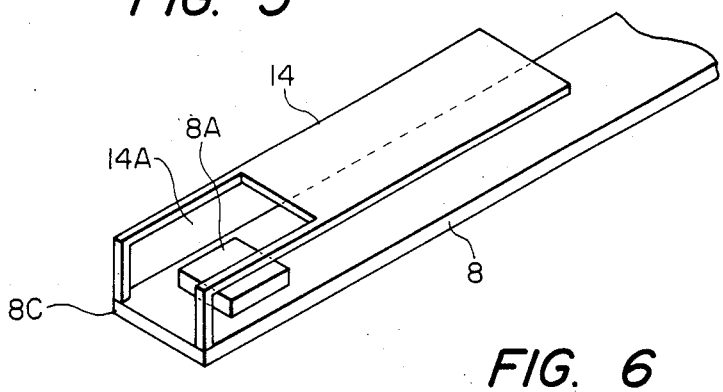
FIG. 5 is a perspective view showing a stationary contact piece and an arc runner in the first embodiment of the invention.

As shown in FIG. 4, the first flat plate 15A is arranged parallel to the surface of the stationary contact 8A, and the metal arc-extinguishing plates 13 are disposed between the first flat plate 15A and the stationary contact piece 8. the second flat plate 15B is arranged parallel to the surface of the stationary contact 8A. When the movable contact **6*a* is moved away from the stationary contact 8*a*, the second flat plate 15B is located between the rear surface 6B of the movable contact piece 6 (where no contact is provided) and the arc runner 14. The arc runner 14 is disposed parallel to the surface of the stationary contact 8A and located between the stationary contact piece 8 and the metal arc-extinguishing plates 13**.

The commutation electrode 15 and the arc runner 14 are preferably made of a magnetic material such as Fe or Ni. The commutation electrode 15 is fitted into the grooves at both ends which are formed, for instance, in the arc cover 11 as shown in FIG. 4.

Similar to the conventional electromagnetic contactor, when current flows through the electromagnetic contactor and the movable contact 6A is moved away from the stationary contact 8A, an arc 12 is formed between the contacts **6*a* and 8A and attracted by the metal arc-extinguishing plates 13. Since the arc runner 14 extends from the surface of the stationary contact piece 8 towards the movable contact 6*a*, the foot of the arc 12 moves readily to the arc runner 14 from the stationary contact 8A. As the commutation electrode 15 is made of magnetic material as described above, the current flowing in the movable contact piece 6 forms a strong magnetic field B, as shown in FIG. 6, and a force F acts on the arc 12. Therefore, the foot of the arc moves readily to the commutation electrode 15 from the movable contact 6*a*. As a result, the arc 12 changes to the state indicated by 12A in FIG. 4. Thereupon, a current flows in the arc runner, as indicated by the arrow, so that the arc is driven towards the arc-extinguishing plates 13. On the other hand, on the side of the commutation electrode 15, owing to the magnetic field formed by the current flowing in the arc runner 14 and the current flowing in the commutation electrode, the arc 12 changes to the state indicated at 12B, then to the state indicated by 12C, and finally to that by 12D. Thus, the arc is extinguished between the arc runner 14 and the first flat plate 15A** and the current is interrupted.

As is apparent from the above description, in the first embodiment of the invention, the foot of the arc 12 is quickly moved from the movable contact **6*a* to the commutation electrode 15. Therefore, the consumption of the movable contact 6*a*** is reduced.

Furthermore, as is clear from the state of the arc indicated by 12D, the arc is extinguished between the first flat plate 15A and the arc runner 14, and therefore all of the arc-extinguishing plates 13 contribute to the arc extinction. Thus, the first embodiment provides an excellent interrupting performance. Since the arc is extinguished by the flat portions of the arc-extinguishing plates 13, very little electrostatic focusing occurs at the foot of the arc, and the thermal conduction is increased, further improving the interrupting performance.

In addition, because in the first embodiment of the invention, the distance between the arc 12 and the arc-extinguishing plates 13 is short, the arc 12 is strongly driven, with the result that the arcing period is short.

FIGS. 7 through 10 show modifications of the commutation electrode 15 in the power switch according to the invention. In the first embodiment described above, the commutation electrode 15 has right-angle corners where the second flat plate meets the third and fourth flat plates. However, in the first modification shown in FIG. 7, the commutation electrode has round corners where the second flat plate 15B meets the third and fourth flat plates 15C and 15D. In the second modification shown in FIG. 8, the technical concept of the first modification is developed so that the second flat plate 15B is curved, that is, the plates 15B, 15C and 15D form a U-shaped plate. In the third modification shown in FIG. 9, the fourth flat plate is inclined. In the fourth modification shown in FIG. 10, the technical concept of the third modification is developed so that instead of the second flat plate 15B, a curved plate is employed.

The power switches having these modifications have the same effects as the first embodiment described with reference to FIGS. 4, 5 and 6.

The above-described power switches according to the invention are provided with the arc runner 14. Even if they have no arc runner, the interrupting performance is improved and the rate of consumption of the movable contact 6A reduced according to the invention. However, if they have the arc runner as described above, the rate of consumption of the stationary contact 8A is less.

Figure 11:
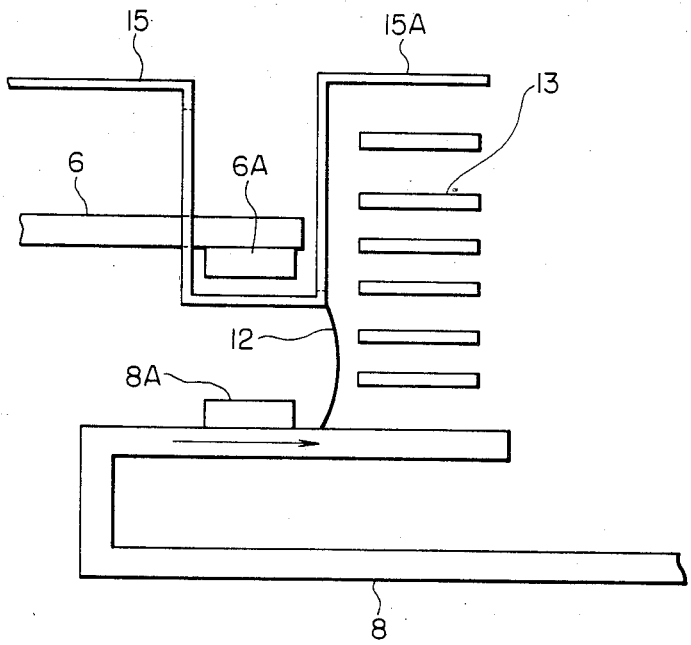
FIGS. 11, 12 and 13 are enlarged side views showing the essential components of second, third and fourth embodiments of the invention, respectively.

FIG. 11 is a sectional view showing the essential components of an electric power switch constructed in accordance with a second embodiment of the invention. In the second embodiment, unlike the first embodiment, no arc runner 14 is employed, and instead the stationary contact piece 8 is bent and extended in a U shape and the stationary contact 8A is provided on the extension.

In the second embodiment, the foot of the arc 12 is moved from the stationary contact 8A to the stationary contact piece 8 by the magnetic field which is created by the current (indicated by the arrow) flowing in the stationary contact piece 8. The rate of consumption of the stationary contact 8A is thus reduced, and the arcing period decreased. Thus, the interrupting performance is further improved.

Figure 12:
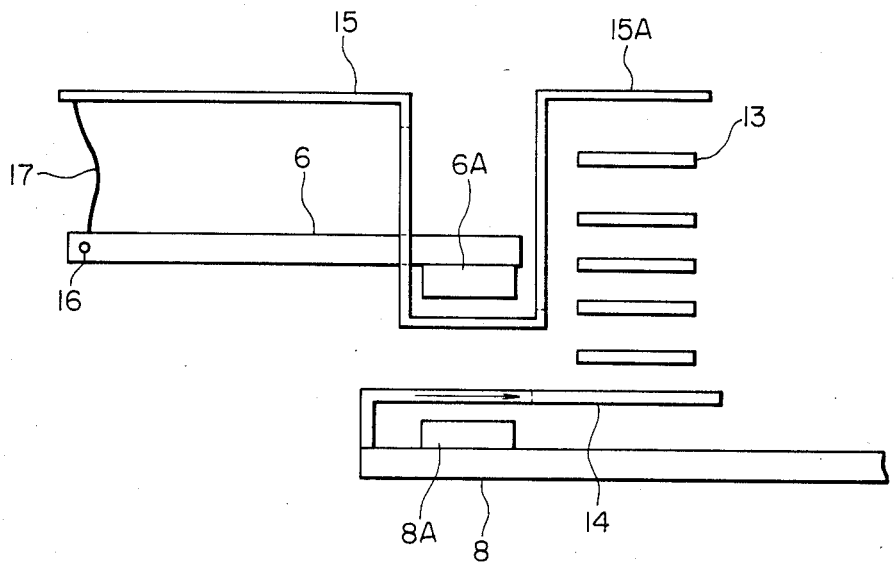

FIG. 12 shows a circuit breaker, which is a third embodiment of the invention. In FIG. 12, reference numeral 16 designates a rotary shaft; and 17, a stranded wire through which the commutation electrode 15 is electrically connected to the movable contact piece 6.

The third embodiment has substantially the same interrupting performance as the first embodiment described above.

Figure 13:
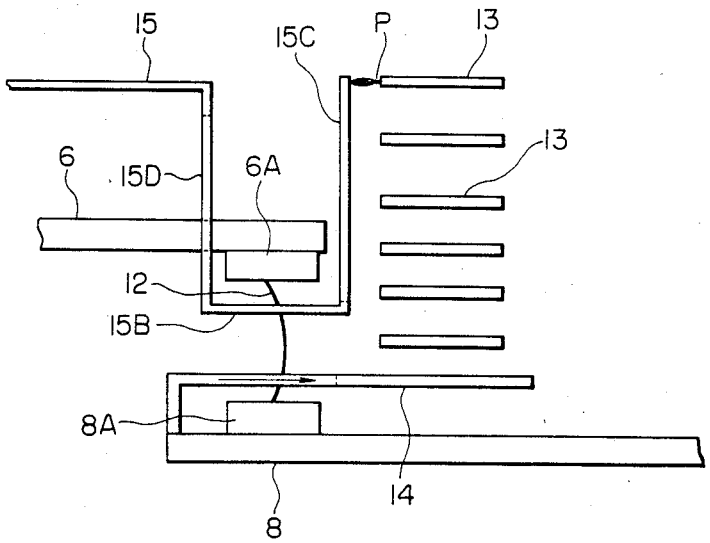

FIG. 13 is a sectional view showing the essential components of a power switch, namely, an electromagnetic contactor, which is a fourth embodiment of the invention.

In the fourth embodiment, the first flat plate 15A included in the first, second and third embodiment is eliminated.

In the fourth embodiment, an arc is liable to be formed at a part P of one edge of the arc-extinguishing plate 13. If an arc is formed at the part P, which includes a sharp edge, electrostatic focusing is liable to occur immediately after the current goes through zero, and the insulation of that part is insufficiently restored. Accordingly, the fourth embodiment has a lower interrupting performance than the first, second or third embodiment described above. Furthermore, in the fourth embodiment, an arc is formed on the edge of the arc-extinguishing plate 13, and therefore heat is not smoothly conducted from the part P of the edge to the other parts, and the temperature of the part P is greatly increased after the current goes through zero. Thus, the interrupting performance of the fourth embodiment is lower than that of the first, second or third embodiment; however, it is still superior to that of the conventional power switch.

In order to manufacture a high-voltage power switch, it is necessary to increase the number of metal arc-extinguishing plates 13. As in the above-described embodiments of the invention, an excellent current interrupting performance can be obtained with the arc-extinguishing plates arranged parallel to the surface of the stationary contact 8*a*. Therefore, the high-voltage power switch can be realized without increasing the area needed for its installation.

Thus, according to the invention, the employment of the commutation electrode and the arc-extinguishing plates improves the interrupting performance and greatly reduces the rate of consumption of the movable contact.

I claim:

1. An electric power switch comprising:

a stationary contact piece having a stationary contact;

a movable contact piece having a movable contact movable into and out of engagement with said stationary contact;

a commutation electrode arranged near said stationary contact and said movable contact in such a manner that when said movable contact is disengaged from said stationary contact, said commutation electrode located at predetermined distances from said stationary contact and movable contact and receives an arc which is formed between said stationary contact and movable contact;

a plurality of metal arc-extinguishing plates arranged parallel to a surface of said stationary contact piece and at a predetermined distance from said commutation electrode and extending in a direction in which said movable contact piece is moved with respect to said stationary piece; and said commutation electrode having a generally U-shape and comprising a first part spaced at a predetermined distance from said metal arc-extinguishing plates and disposed parallel to said metal arc-extinguishing plates.

2. The electric power switch as claimed in claim 1, wherein, when said movable contact is disengaged from said stationary contact, a part of said commutation electrode extends to a side of said stationary contact from a side of one surface of said movable contact piece opposite a surface thereof on which said stationary contact is provided.

3. The electric power switch as claimed in claim 1, wherein said commutation electrode has a slot through which said movable contact piece moves to contact said stationary contact piece.

4. The electric power switch as claimed in claim 1, wherein said commutation electrode is made of a magnetic material.

5. the electric power switch as claimed in claim 1, wherein said generally U-shape of said commutation electrode comprises:

a second part which, under the condition that said movable contact is disengaged from said stationary contact, is located on the side of said stationary contact with respect to one surface of said movable contact piece which is opposite to the other surface of said movable contact piece on which said movable contact is provided; and a third part through which said first part is connected to said second part, said third part being spaced a predetermined distance from one side of said metal arc-extinguishing plates.

6. The electric power switch as claimed in claim 5, wherein said commutation electrode further comprises:

a fourth part which is connected to one end of said second part which is opposite to the other end of said second part which is connected to said third part, said fourth part extending parallel to a direction in which said movable contact piece is moved.

7. The electric power switch as claimed in claim 5, wherein said second part of said commutation electrode is flat.

8. The electric power switch as claimed in claim 5, wherein said second part of said commutation electrode is curved towards said stationary contact.

9. The electric power switch as claimed in claim 1, wherein said stationary contact piece comprises an arc runner, said arc runner being electrically connected to said stationary contact piece and extending towards said movable contact.

10. The electric power switch as claimed in claim 8, wherein said arc runner is made of a magnetic material.

11. The electric power switch as claimed in claim 1, wherein said stationary contact piece comprises:

a first part having a stationary contact extending parallel to said metal arc-extinguishing plates; and a second part integral with and extending from one end of said first part parallel to said first part.

* * * * *